US005316298A

United States Patent [19]

Hutin et al.

[11] Patent Number: 5,316,298

[45] Date of Patent: May 31, 1994

[54] GOLF CLUB HEAD HAVING VIBRATION DAMPING MEANS

[75] Inventors: Patrice Hutin; Roger Cleveland, both of Los Angeles; Daniel J. Stone, Long Beach, all of Calif.

[73] Assignee: Skis Rossignol S.A., France

[21] Appl. No.: 45,784

[22] Filed: Apr. 14, 1993

[30] Foreign Application Priority Data

Apr. 14, 1992 [FR] France ..... 92.04882

[51] Int. Cl.[5] ..... A63B 53/04

[52] U.S. Cl. ..... 273/78; 273/167 H; 273/173; 273/DIG. 23

[58] Field of Search ..... 273/167 R, 168, 78, 273/169, 170, 171, 172, 173, 174, 175, 167 A, 167 B, 167 C, 167 D, 167 E, 167 F, 167 G, 167 H, 167 J, 167 K, 77 A, 164.1, 162 R, 193 R, 194 A

[56] References Cited

U.S. PATENT DOCUMENTS

| | | | |
|---|---|---|---|
| 1,658,581 | 2/1928 | Tobia | 273/169 X |
| 1,968,627 | 7/1934 | Young | 273/169 |
| 2,846,228 | 8/1958 | Reach | 273/167 FX |
| 4,582,321 | 4/1986 | Yoneyama | 273/173 X |
| 4,811,950 | 3/1989 | Kobayashi . | |
| 4,875,679 | 10/1989 | Movilliat et al. . | |
| 4,928,972 | 5/1990 | Nakanishi et al. . | |
| 4,964,640 | 10/1990 | Nakanishi | 273/167 H |
| 5,000,454 | 3/1991 | Soda | 273/167 H |
| 5,067,715 | 11/1991 | Schmidt | 273/167 H X |
| 5,083,778 | 1/1992 | Douglass | 273/173 X |
| 5,106,094 | 4/1992 | Desbiolles et al. . | |
| 5,213,328 | 5/1993 | Long | 273/167 H |

FOREIGN PATENT DOCUMENTS

| | | | |
|---|---|---|---|
| 2672226 | 8/1992 | France | 273/170 |
| 20069 | of 1901 | United Kingdom . | |
| 19242 | 6/1903 | United Kingdom . | |

*Primary Examiner*—Vincent Millin
*Assistant Examiner*—Sebastiano Passaniti
*Attorney, Agent, or Firm*—Parkhurst, Wendel & Rossi

[57] ABSTRACT

A golf club head including a front strike face, a sole extending rearwardly from a bottom region of the front strike face, a rear surface opposed to the front strike face, and a vibration damper provided on the rear surface. The vibration damper includes a constraining member having a high Young's modulus connected to the rear surface of the club head through an interposed visco-elastic material.

33 Claims, 4 Drawing Sheets

GOLF CLUB HEAD HAVING VIBRATION DAMPING MEANS

BACKGROUND OF THE INVENTION

The invention concerns a golf club head.

It is known that the head of a golf club, either a "metal wood" or "iron" is forged, molded, cast, or milled and will be joined to a shaft. In the case of irons, the head includes a planar strike face on one side thereof, a sole on an underside thereof, and an open cavity on a rear side, opposite the strike face, above the sole. Depending on the manufacturer and on the desired effects and fabrication method, this cavity assumes very different shapes. With the case of metal woods, a top surface and the sole of the club extend back from the strike face and are joined at a skirt portion of the club to define a closed cavity.

It is further known that when the club head strikes a ball, vibrations are generated which are annoying to the player. Thus, it is desirable to dampen such vibrations.

Vibration dampers have been used in sports equipment. For example, the assignee of the present application has proposed, in French patent document A-2,575,393, integrating a vibration damper in skis, wherein the damper consists of a stress plate with a high Young's modulus and is bonded to the ski by a visco-elastic material. This plate is located either near the ski heel, where the ski tip begins, or at the front of the boot fastening zone.

SUMMARY OF THE INVENTION

An object of the invention is to provide a golf-club head capable of attenuating the vibrations caused by striking a golf ball and thus providing improved feel with less physical stress transmitted to the player.

The golf club head of the present invention with respect to irons includes a front strike-face, a sole, a rear face comprising a cavity above the sole and at the back of the strike face, and a vibration damper consisting of constraining means (e.g., a rigid stress plate with a high Young's modulus) connected by a visco-elastic material to the rear face preferably within the cavity. With respect to metal woods, wherein the cavity is closed by the top surface, sole and skirt portion, the vibration damper is connected at least to the back side of the strike face within the closed cavity of the club head.

Accordingly, with irons the constraining means (e.g., rigid stress plate) is fixed to the rear face in the cavity of the club head through an interposed visco-elastic material, and with metal woods the constraining means (e.g., rigid stress plate) is fixed at least to the backside of the strike face within the closed cavity through an interposed visco-elastic material. If used in the interior of the metal woods, the vibration damper may exclude the constraining means and employ the visco-elastic material alone. Alternatively, the constraining means may consist of a thin flexible layer of material such as aluminum.

It is known that "visco-elastic material" serves to lower the vibration amplitude by degrading part of the energy of deformation into heat. The main features of the visco-elastic materials are a low Young's modulus and a high damping factor and they have long been used in aviation, in cars or in the manufacture of skis. Accordingly, they need not be described in detail herein.

The main characteristic of a visco-elastic material is its intrinsic damping coefficient (tan $\delta$). This characteristic is basically affected by the temperature and the vibration frequency. When used at least with irons, it is important that the visco-elastic material evince a maximum damping range at ambient temperature. The damping coefficient should be between 0.4 and 1.2. Beyond 1.2, excessive absorption of the energy from the ball impact is often observed, and hence there is a loss in efficiency. Below 0.4, the visco-elastic effect of the material is often too low.

As already stated previously, it is important that the visco-elastic materials used shall evince their optimal properties at the typical temperatures in which the golf clubs are used, in particular near ambient temperature.

It was found that the visco-elastic sheet should be less than 2 mm thick, and preferably between 0.5 and 1 mm. If the thickness is less than 0.5 mm, practically no vibration damping effect is achieved. On the other hand, if the thickness exceeds 1.0 mm, there is loss of efficiency while the cost is higher. Good results are offered by a sheet about 0.5 mm thick.

The visco-elastic material is one used presently in conventional applications, for instance, skiing. Among such materials are butyl rubbers and, synthetic elastomers, whether used individually or mixed or including fillers.

Advantageously, the typical visco-elastic sheet is adhered by an adhesive coat to the constraining means (e.g., the rigid plate) and the corresponding surface of the club head. In practice, a double-faced adhesive strip is deposited on the visco-elastic sheet so it can be conveniently applied to the desired surface of the club head.

In one embodiment of the invention, the sheet may consist of a stack of several elementary visco-elastic foils of different properties. The damping properties of each foil are offset with respect to temperature at a given vibration frequency or are offset in frequency for a given temperature.

In another embodiment of the invention, the sheet is composed of a juxtaposition of elementary zones each evincing optimal damping properties which also are offset in temperatures and frequency.

With irons, the constraining means preferably consists of a rigid plate, and with metal woods the constraining means can consist of a rigid plate and/or a layer of more flexible material such as aluminum. The constraining means facilitates the ability of the visco-elastic material to transform vibration energy into heat.

Advantageously in practice, the following design features apply.

A) The rigid plate evinces a Young's modulus (E) larger than 10,000 MPa and a thickness between 0.07 and 2.0 mm, preferably between 0.5 mm and 2.0 mm, more preferably near 1 mm. If the Young's modulus (E) is less than ten-thousand (10,000) MPa, the rigid plate does not act as effectively as a stress plate and damping is less effective. This also is the case when the thickness is less than 0.7 mm, whereas when in excess of 2 mm, cost and weight are unnecessarily increased without matching improvement.

B) The rigid plate with a high Young's modulus is selected from aluminum alloys, aluminum-zinc-magnesium alloys (e.g., ZICRAL® made by Cegedur-Pechiney), and laminated heat-setting materials reinforced with carbon or glass fibers. If a more flexible material is needed aluminum in sheet or foil form can be used.

The damper of the present invention should be as near the center of the rear cavity and match the shape and substantially follow the entire surface of the cavity designed to absorb vibrations in an improved manner. With respect to woods wherein the damper is fastened on the rear surface of the club head outside the closed cavity, the damper should assume the generally elongate shape of the skirt portion of the club head.

BRIEF DESCRIPTION OF THE DRAWINGS

The present invention will be better understood upon reading the following description taken in conjunction with the attached drawings, wherein.

DETAILED DESCRIPTION OF THE INVENTION

Figure 1:
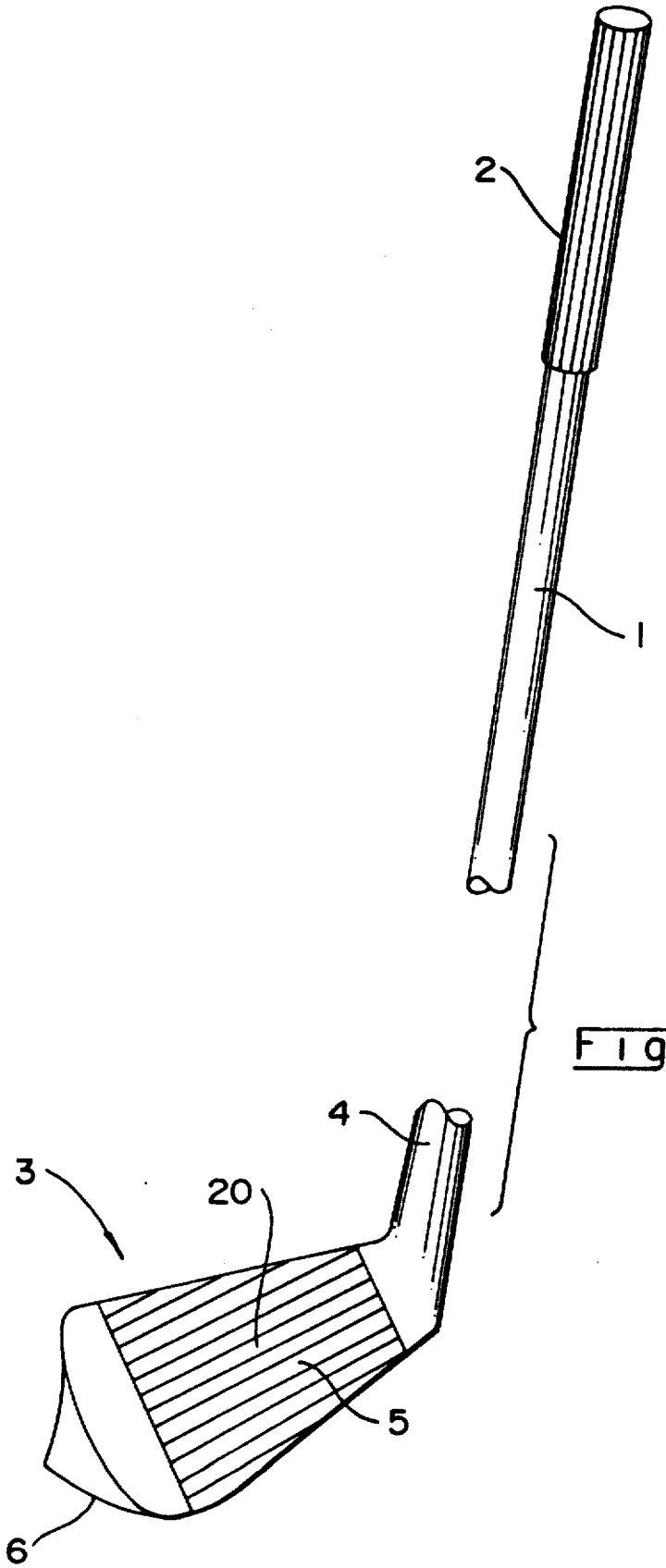
FIG. 1 is a simplified perspective view of a conventional so-called "iron" golf-club.
Figure 2:
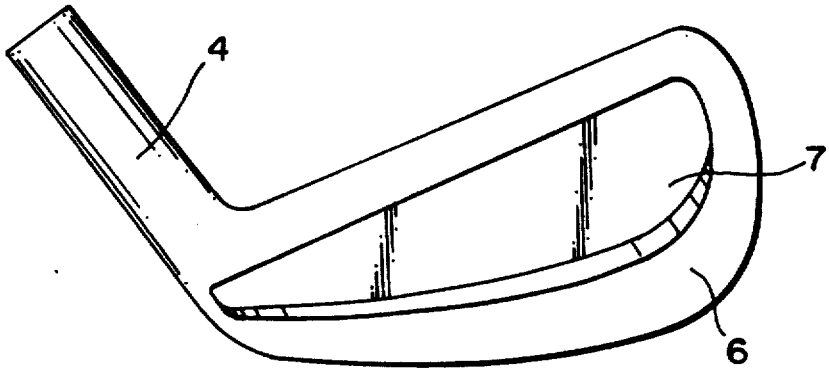
FIG. 2 is a rear view of the back of the club head of FIG. 1.

FIG. 1 shows a conventional golf iron which includes a shaft 1, illustratively made of iron or reinforced plastic, terminating at one end into a grip 2 and connected by a hosel 4 at its other end to a head 3. The weight and shape of the club and head 3 vary in relation to the iron number. At its front, the head 3 comprises a planar, grooved strike face 5 cut in the body of the head. A sole 6 extends rearwardly from a bottom region of the strike face 5. The head 3 at its rear comprises a cavity 7 (FIG. 2) of which the shape varies with the manufacturer, the desired effects and the particular manufacturing process (molding, forging, casting, milling, and the like). The cavity is partially defined by a thin-walled portion 8 between the rear surface of the club and the front strike face.

Figure 3:
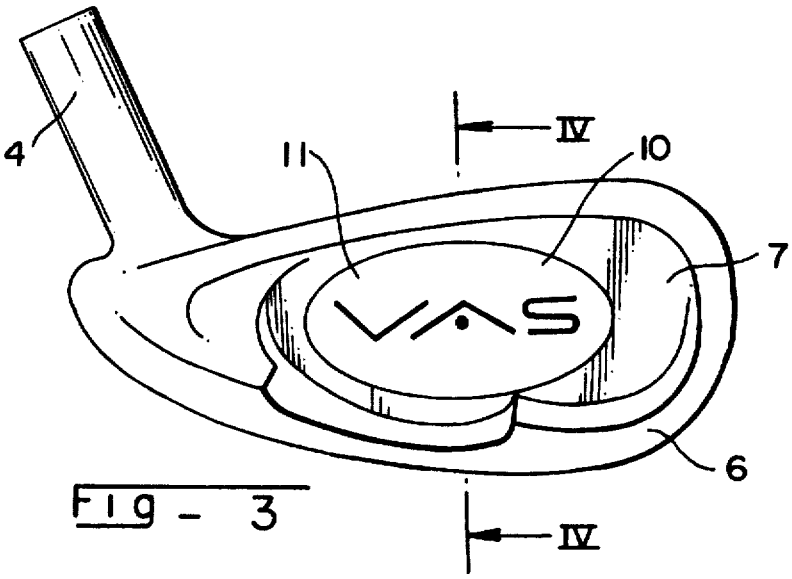
FIG. 3 is a golf club head of the invention also shown in rear view.
Figure 4:
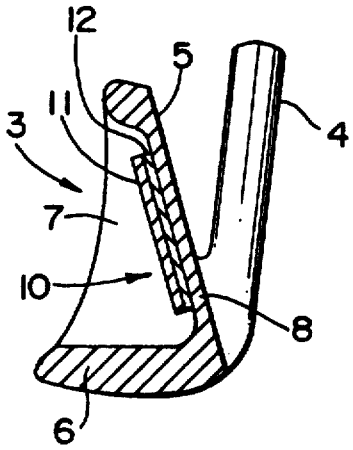
FIG. 4 is a cross-sectional view of the club head of FIG. 3 taken along line IV—IV of FIG. 3.
Figure 5:
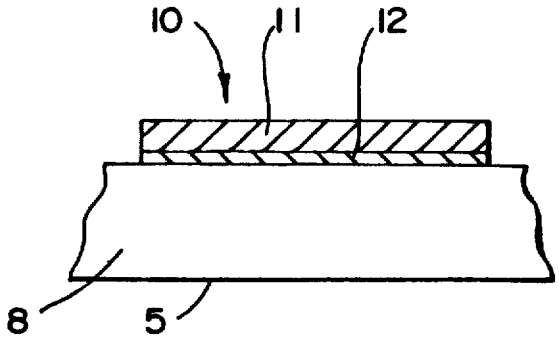
FIG. 5 is a sectional detailed view of the vibration damper of the invention.

In the invention, the cavity 7 of the iron club head receives a characteristic damper 10 (FIG. 3) located on the thin-walled portion 8 at the center of the cavity and comprising, starting at the outside, constraining means, i.e., a rigid plate 11, of which the shape and surface essentially match the shape of the cavity 7, and a visco-elastic sheet 12. The plate 11 can be made of an aluminum alloy or an aluminum-zinc-magnesium alloy sold by Cegedur-Pechiney as ZICRAL, and preferably has a Young's modulus of 12,000 MPa and a thickness of 1 mm.

The visco-elastic sheet 12 has a high damping coefficient, and both the inside and outside surfaces thereof are previously coated with an adhesive in a thorough manner so as to ensure bonding between the visco-elastic sheet 12 and the rigid plate 11 on one hand, and on the other between the sheet 12 and the rear side of the head 3, i.e., in the cavity 7. The visco-elastic sheet 12 preferably is 1.0 mm thick and has a damping coefficient of which the tan $\delta$ at 25° C. is between 0.4 and 1.2, preferably between 0.6 and 0.8.

The characteristic damper 10 preferably is mounted on the back surface of the iron in line with the center of gravity 20 of the club head (as seen on the strike face), the center of gravity 20 being the ideal impact point.

Figure 6A:
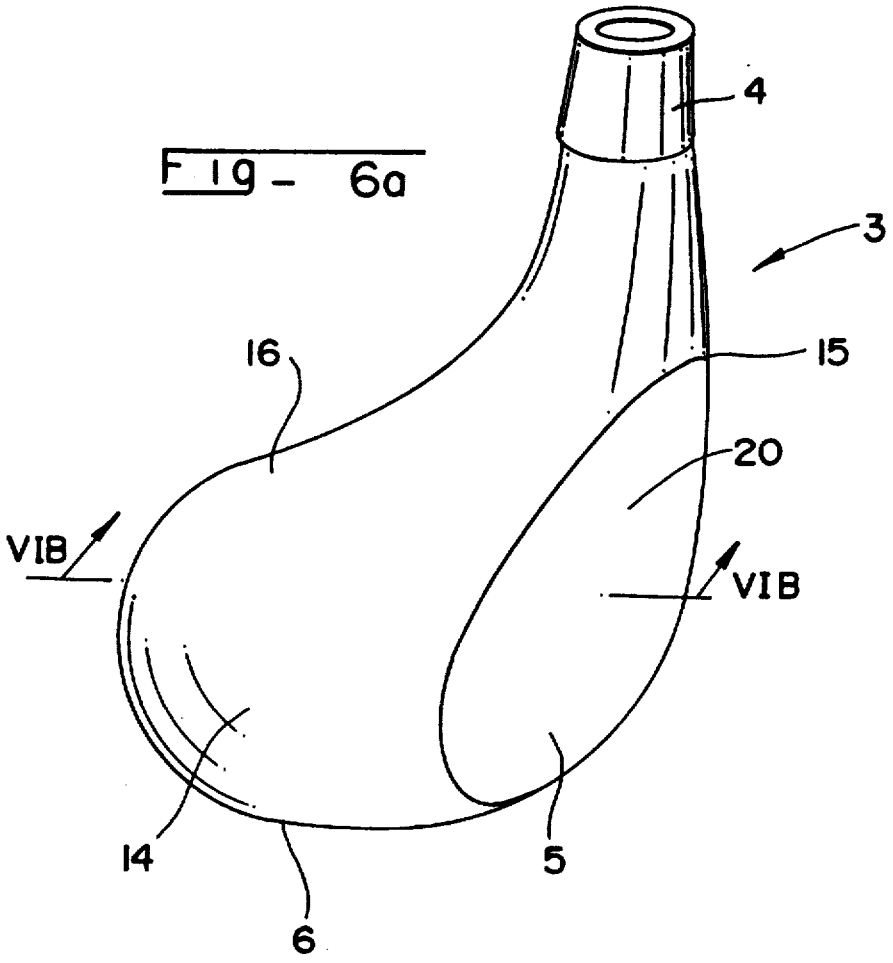
FIG. 6*a* is a perspective view of a so-called "metal wood" golf club according to the invention.
Figure 6B:
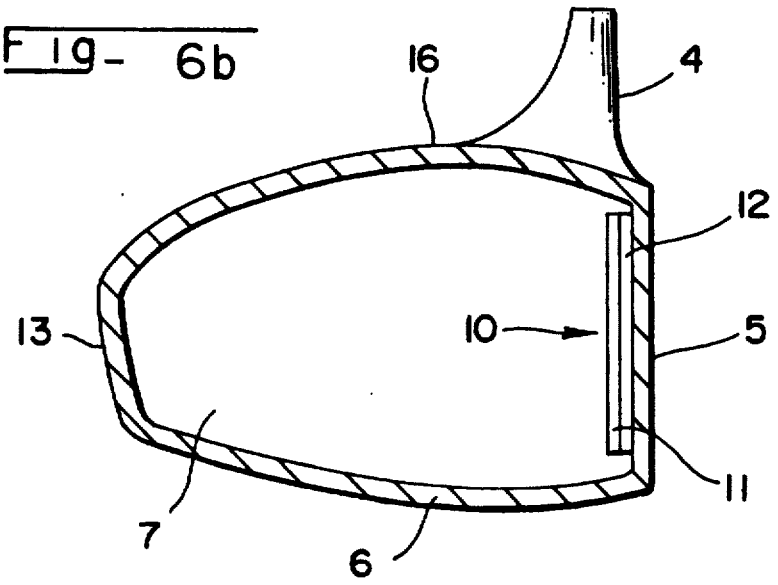
FIG. 6*b* is a cross-sectional view taken along line VIB—VIB of FIG. 6*a*.

FIG. 6*a* shows a so-called "metal wood" golf club head according to the invention. FIG. 6*b* shows a cross-sectional view taken along VIB—VIB of FIG. 6*a*, wherein the damper 10 is positioned on the rear of the strike face 5 within the closed cavity 7. The damper 10 in this position should also be in line with the center of gravity 20 of the strike face 5.

Figure 6C:
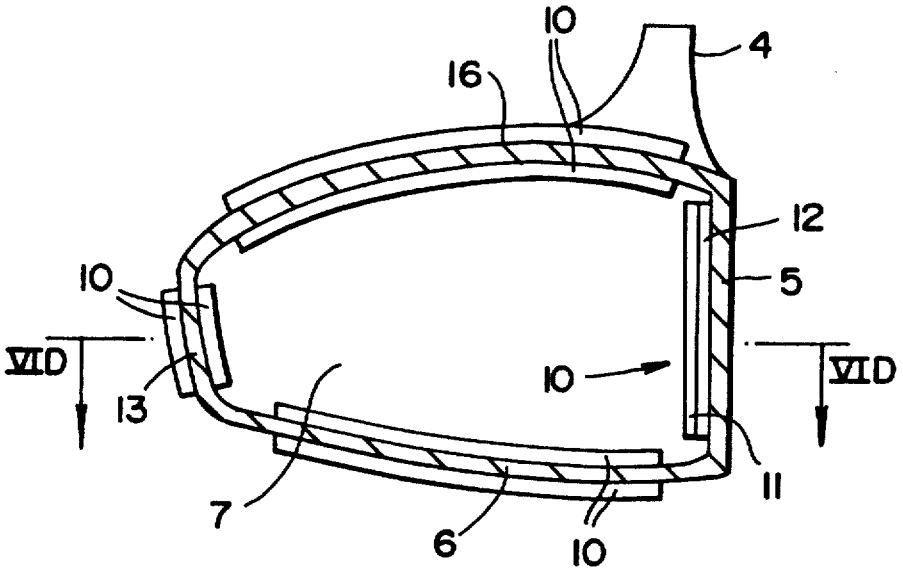
FIG. 6*c* is a cross-sectional of a modified metal wood golf club according to the invention.
Figure 6D:
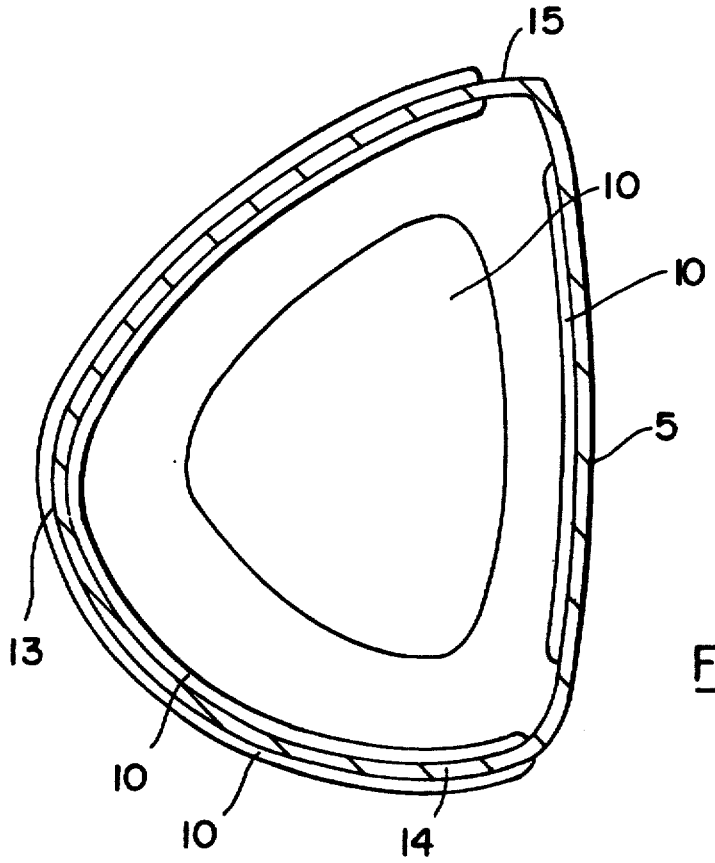
FIG. 6*d* is a cross-sectional view taken along line VID—VID of FIG. 6*c*.

FIGS. 6*c* and 6*d* show that with metal woods the damper 10 can also be positioned both internally and externally i) along the skirt portion 13 from the toe 14 of the club head substantially to the heel 15 thereof, ii) on or under the top surface 16 (i.e., the so-called "crown") of the club head, and iii) on or above the sole 6 of the club head. The external dampers should include a rigid plate as the constraining means, since the rigid plate also serves to protect the visco-elastic material. The internal dampers can include rigid constraining means if the internal surfaces of the club head are designed to be flat. If the internal surfaces are curved, less rigid (i.e., flexible) constraining means can be employed. The flexible constraining means should be able to act as a stress plate. If positioned in the interior of the club head, it is also possible to omit the constraining means from the vibration damper and use the layer of visco-elastic material alone.

The dampers are connected inside the club head by providing access means in the rear of the club head, a removable sole plate, or by fastening (e.g., via adhesive) the dampers to parts of the club head and then assembling (e.g., welding) the club head into an integral body.

While FIGS. 6*a*–6*d* show vibration dampers at several locations on external and internal surfaces of the club head, it is possible to position the dampers at any one location or a combination of several select locations to achieve desired damping characteristics. Preferably, vibration dampers are employed on the back of the strike face (FIG. 6*b*) and/or on the top surface (crown) 16. When the dampers are employed on the external surfaces of the club head, it is also possible to recess the vibration dampers within the external surfaces of the club head to minimize wind drag and better protect the dampers from damage.

The present invention is effective in absorbing vibrations in a golf club head resulting from impact with a golf ball.

What is claimed is:

1. A golf club head comprising:

a front strike face;

a sole extending rearwardly from a bottom region of said front strike face;

a rear surface opposed to said front strike face; and vibration damping means provided at least on said rear surface and comprising constraining means connected to said rear surface by a visco-elastic material, said constraining means comprising a rigid plate having a Young's modulus greater than 10,000 MPa and a thickness between 0.07 and 2.0 mm.

2. The golf club head of claim 1, wherein said having a rigid plate having a has a thickness between 0.5 and 2.0 mm.

3. The golf club head of claim 2, wherein said rigid plate has a Young's modulus greater than 12,000 MPa and a thickness of 1.0 mm.

4. The golf club head of claim 2, wherein said rigid plate comprises at least one material selected from the group consisting of aluminum alloys, aluminum -zinc-magnesium alloys, laminated heat-setting materials reinforced with carbon fibers, laminated heat-setting materials reinforced with glass fibers, thermoplastics reinforced with carbon fibers, and thermoplastics reinforced with glass fibers.

5. The golf club head of claim 4, wherein said rigid plate consists of ZICRAL.

6. The golf club head of claim 1, wherein said visco-elastic material comprises a layer having a thickness of no more than 1 mm and exhibits an intrinsic damping coefficient, tan δ, between 0.4 and 1.2.

7. The golf club head of claim 6, wherein said visco-elastic material comprises at least one material selected from the group consisting of butyl rubbers and synthetic elastomers.

8. An iron golf club head comprising:

a front strike face;

a sole extending rearwardly from a bottom region of said front strike face;

a rear surface opposed to said front strike face and comprising a cavity located above said sole and in back of said strike face to define a thin wall portion between said front strike face and said rear surface; and vibration damping means provided in said cavity and comprising constraining means connected to said rear surface by a visco-elastic material, said constraining means comprising a rigid plate having a Young's modulus greater than 10,000 MPa and a thickness between 0.07 and 2.0 mm.

9. The golf club head of claim 8, wherein said rigid plate has a thickness between 0.5 and 2.0 mm.

10. The golf club head of claim 9, wherein said rigid plate has a Young's modulus greater than 12,000 MPa and a thickness of 1.0 mm.

11. The golf club head of claim 9, wherein said rigid plate comprises at least one material selected from the group consisting of aluminum alloys, aluminum -zinc-magnesium alloys, laminated heat-setting materials reinforced with carbon fibers, laminated heat-setting materials reinforced with glass fibers, thermoplastics reinforced with carbon fibers, and thermoplastics reinforced with glass fibers.

12. The golf club head of claim 11, wherein said rigid plate consists of ZICRAL.

13. The golf club head of claim 8, wherein said visco-elastic material comprises a layer having a thickness of no more than 1 mm and exhibits an intrinsic damping coefficient, tan δ, between 0.4 and 1.2.

14. The golf club head of claim 13, wherein said visco-elastic material comprises at least one material selected from the group consisting of butyl rubbers and synthetic elastomers.

15. A metal wood golf club head comprising:

a front strike face;

a sole extending rearwardly from a bottom region of said front strike face;

a top surface extending rearwardly from a top region of said front strike face;

an arcuate skirt portion joining said top surface to said sole and extending from a toe region of said strike face to a heel region of said strike face, wherein the front strike face, sole, top surface and arcuate skirt portion define a cavity within the club head; and vibration damping means provided on the club head at a position other than on the front strike face, comprising constraining means connected to the club head by a visco-elastic material, said constraining means comprising a rigid plate having a Young's modulus greater than 10,000 MPa and a thickness between 0.07 and 2.0 mm.

16. The metal wood golf club head of claim 15, wherein said vibration damping means is provided on a rear surface of said front strike face within said cavity in substantial alignment with a center of gravity of said strike face.

17. The metal wood golf club head of claim 15, wherein said vibration damping means is provided internally along said arcuate skirt portion.

18. The metal wood golf club head of claim 15, wherein said vibration damping means is provided externally along said arcuate skirt portion.

19. The metal wood golf club head of claim 18, wherein said vibration damping means is connected to a rear surface of said arcuate skirt portion.

20. The metal wood golf club head of claim 15, wherein said vibration damping means is provided internally along said top surface.

21. The metal wood golf club head of claim 15, wherein said vibration damping means is provided externally along said top surface.

22. The metal wood golf club head of claim 15, wherein said vibration damping means is provided internally along said sole.

23. The metal wood golf club head of claim 15, wherein said vibration damping means is provided externally along said sole.

24. The metal wood golf club head of claim 15, wherein said rigid plate has a thickness between 0.5 and 2.0 mm.

25. The metal wood golf club head of claim 24, wherein said rigid plate has a Young's modulus greater than 12,000 MPa and a thickness of 1.0 mm.

26. The metal wood golf club head of claim 24, wherein said rigid plate comprises at least one material selected from the group consisting of aluminum alloys, aluminum-zinc-magnesium alloys, laminated heat-setting materials reinforced with carbon fibers, laminated heat-setting materials reinforced with glass fibers, thermoplastics reinforced with carbon fibers, and thermoplastics reinforced with glass fibers.

27. The metal wood golf club head of claim 26, wherein said rigid plate consists of ZICRAL.

28. The metal wood golf club head of claim 26, wherein said visco-elastic material comprises at least one material selected from the group consisting of butyl rubbers and synthetic elastomers.

29. The metal wood golf club of claim 15, wherein said rigid plate consists of aluminum.

30. The metal wood golf club head of claim 15, wherein said visco-elastic material comprises a layer having a thickness of no more than 1 mm and exhibits an intrinsic damping coefficient, tan δ, between 0.4 and 1.2.

31. A metal wood golf club head comprising:

a front strike face;

a sole extending rearwardly from a bottom region of said front strike face;

a top surface extending rearwardly from a top region of said front strike face;

an arcuate skirt portion joining said top surface to said sole and extending from a toe region of said strike face to a heel region of said strike face, wherein the front strike face, sole, top surface and arcuate skirt portion define a cavity within the club head; and vibration damping means provided on the club head at a position other than on the front strike face, comprising constraining means connected to the club head by a visco-elastic material, said constraining means comprising a flexible layer having a Young's modulus greater than 10,000 MPa and a thickness between 0.07 and 2.0 mm.

32. The metal wood golf club head of claim 31, wherein said flexible layer consists of aluminum.

33. The metal wood golf club head of claim 31, wherein said flexible layer has a thickness between 0.5 and 2.0 mm.

* * * * *

UNITED STATES PATENT AND TRADEMARK OFFICE

CERTIFICATE OF CORRECTION

PATENT NO. : 5,316,298

DATED : May 31, 1994

INVENTOR(S) : Patrice HUTIN and Daniel J. STONE

It is certified that error appears in the above-identified patent and that said Letters Patent is hereby corrected as shown below:

Column 4, lines 66-67, claim 2, change "having a rigid plate having a" to --rigid plate--.

Signed and Sealed this

Fourteenth Day of March, 1995

*Attest:*

*Attesting Officer*

BRUCE LEHMAN

*Commissioner of Patents and Trademarks*